US006253933B1

(12) United States Patent
Yang

(10) Patent No.: US 6,253,933 B1
(45) **Date of Patent: *Jul. 3, 2001**

(54) SHELVING RACK

(76) Inventor: Hsin Chen Yang, 483 Sec. 2, Tou Yuan Road, Pei Tou Township, Changhua Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/417,207

(22) Filed: Oct. 13, 1999

(51) Int. Cl.[7] ..... A47B 57/34

(52) U.S. Cl. ..... 211/187; 108/147.12; 108/147.13; 108/147.15; 108/147.17

(58) Field of Search ..... 211/187, 181.1; 108/106, 107, 147.12, 147.13, 147.14, 147.15, 147.17, 147.18; 403/235, 256, 261, 374.1

(56) References Cited

U.S. PATENT DOCUMENTS 5,427,465 * 6/1995 Sato ..... 403/394 X
6,044,988 * 4/2000 Yang ..... 211/187

* cited by examiner

*Primary Examiner*—Daniel P. Stodola
*Assistant Examiner*—Erica B. Harris
(74) *Attorney, Agent, or Firm*—Bacon & Thomas, PLLC

(57) ABSTRACT

A rack with adjustable shelving may be assembled and disassembled through the engagement of plural locating pieces along the length of support rods and the securing of each locating piece to the rod by a holding piece which also has at least one retaining seat for engagement by a retaining piece carried on a corner of a rectangular shelf.

2 Claims, 7 Drawing Sheets

SHELVING RACK

FIELD OF INVENTION

The present invention relates generally to a rack, and more particularly to a shelving rack that can be easily assembled and disassembled.

BACKGROUND OF THE INVENTION

The U.S. Pat. Nos. 3,757,705; 5,390,803; 4,656,952; 5,676,263; 4,852,501; 4,595,107; and the U.S. Pat. Ser. No. 09/305,081 disclose a rack comprising a plurality of tapered tubes and locating pieces, which are fasten with the upright support rods. In the process of adjusting the level of the shelf of the rack, it is necessary to adjust the tapered tubes and the locating pieces. The adjustment of the tapered tubes and the locating pieces can not be easily carried out.

SUMMARY OF THE INVENTION

The primary objective of the present invention is to provide a rack which can be easily assembled and disassembled.

In keeping with the principle of the present invention, the foregoing objective of the present invention is attained by a rack comprising a plurality of upright support rods, locating pieces, holding pieces, and shelves. The shelves are supported by the upright support rods in conjunction with the locating pieces and the holding pieces such that the position of the shelves can be easily adjusted. Each holding piece is formed of an arcuate male piece and an arcuate female piece. The shelves are supported by the upright support rods in conjunction with the locating pieces and the holding pieces. The holding pieces are located by the locating pieces at a certain level of the upright support rods such that the shelves are retained at the level by the shelf-holding seats of the holding pieces.

The forgoing objective, features, and functions of the present invention will be more readily understood from the following detailed description of the present invention with reference to the accompanying drawings.

DETAILED DESCRIPTION OF THE INVENTION

Figure 1:
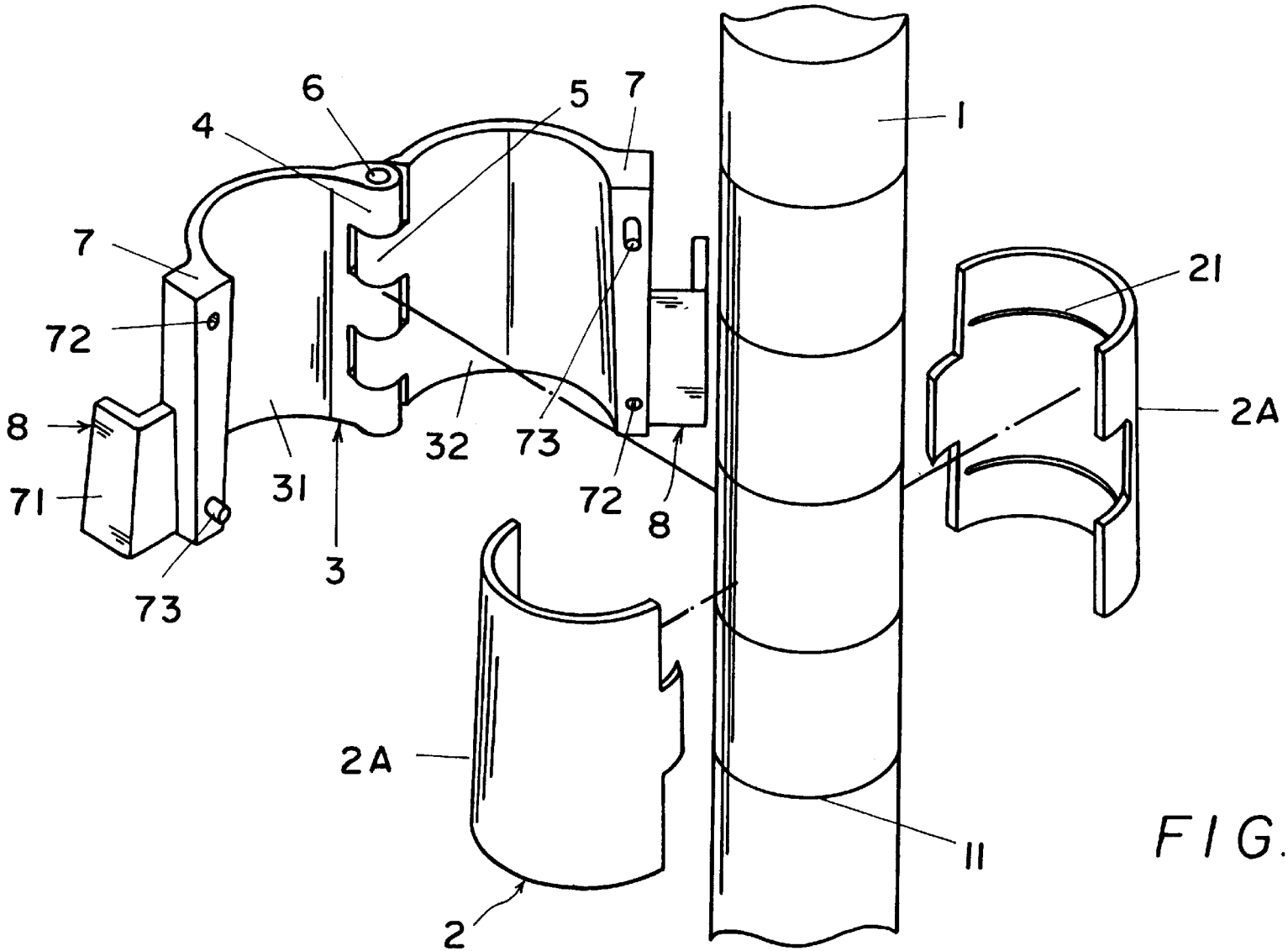
FIG. 1 shows an exploded partial perspective view of the present invention.
Figure 2:
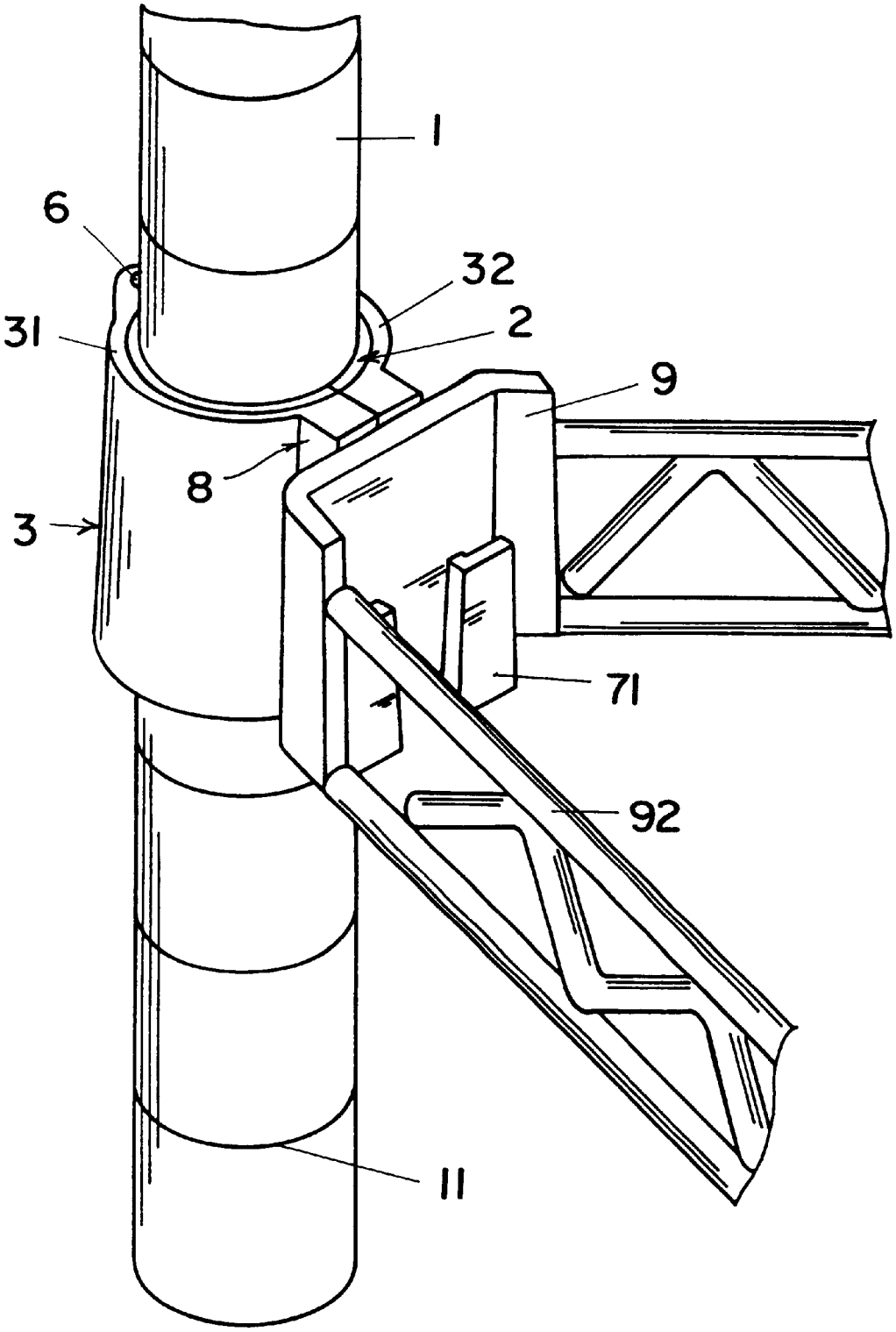
FIG. 2 shows a partial perspective view of the present invention in assembled form.
Figure 3:
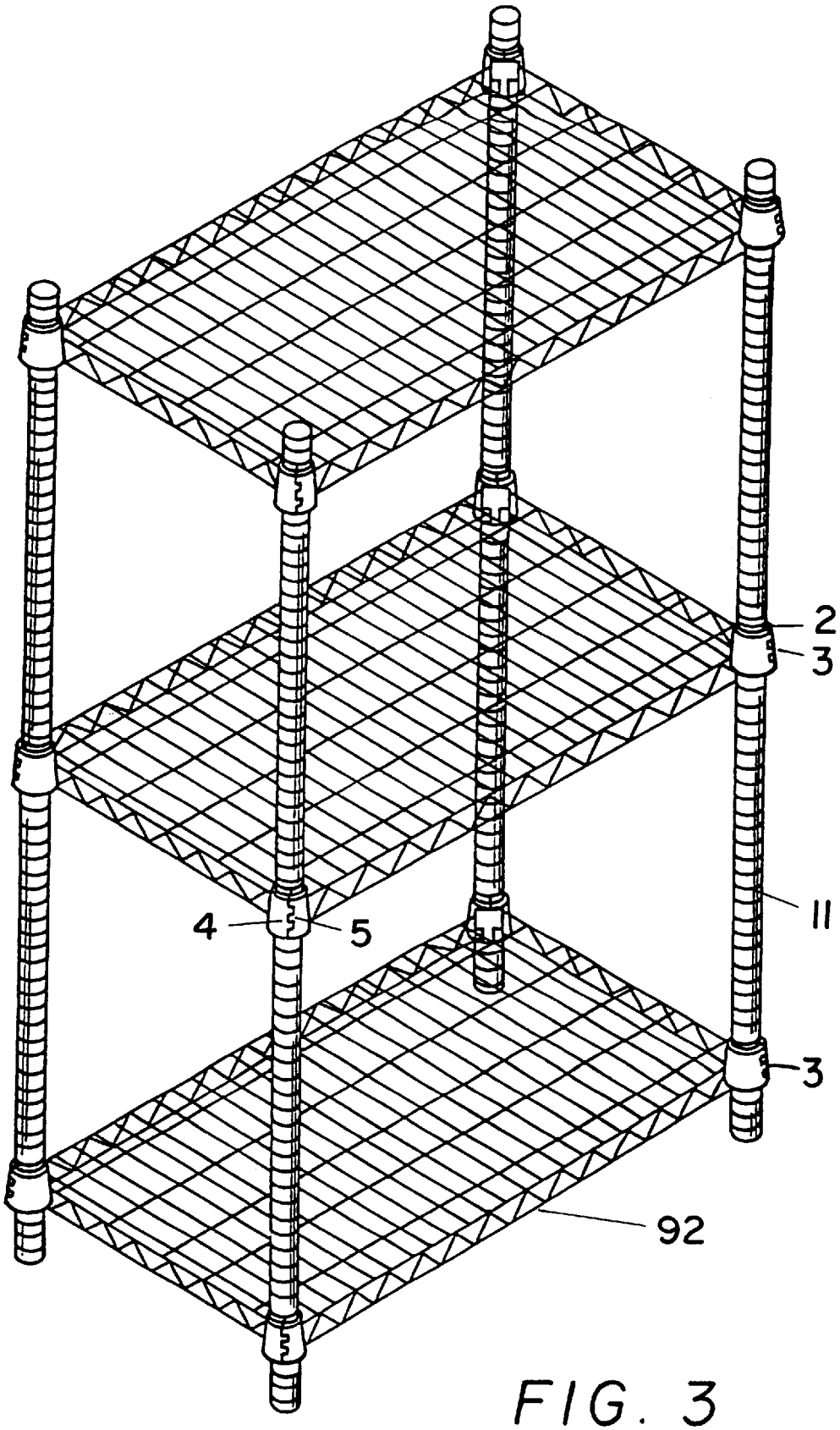
FIG. 3 shows a perspective view of the present invention.

As shown in FIGS. 1–3, a rack embodied in the present invention includes a plurality of upright support rods 1, locating pieces 2, shelves 92, and holding pieces 3. The upright support rods 1 are each provided in the outer wall thereof with a plurality of circular grooves 11 that are longitudinally spaced at equal intervals. Each of the locating pieces 2 is formed of two semicylindrical symmetrical parts

2A, each of which is provided in an inner wall thereof with a plurality of circular ribs 21. The shelves 92 are each rectangular in shape and are provided at each of four corners thereof with a retaining piece 9 which has an opening 91. Each of the holding pieces 3 is formed of an arcuate male piece 31 and an arcuate female piece 32.

The male piece 31 is provided in one side thereof with a first joint 4, and in another side thereof with a protrusion 7 which in turn is provided with a retaining body 71, a mortise 72, and a tenon 73.

The female piece 32 is provide in one side thereof with a second joint 5. The female piece 32 is jointed with the male piece 31 by interlocking the second joint 5 and the first joint 4 together with a pin 6.

The female piece 32 is further provided at the other side thereof with a protrusion 7 which has a retaining body 71, a mortise 72 and a tenon 73, which are engageable with the corresponding tenon 73 and the mortise 72 of the male piece 31.

Figure 4:
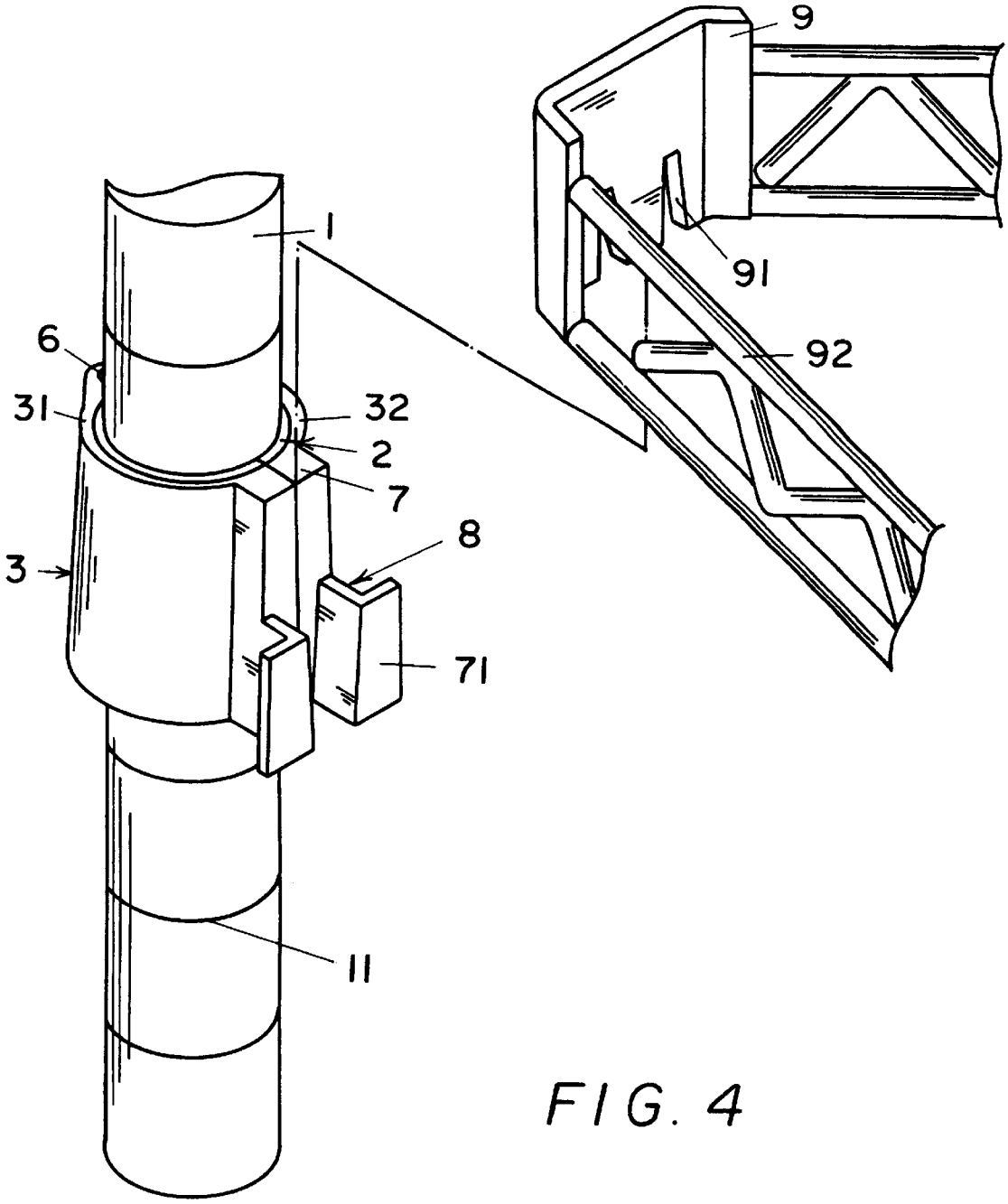
FIG. 4 shows a schematic view of the disassembly of the present invention.

In assembly, the locating pieces 2 are located on the upright support rod 1 such that the circular ribs 21 of the locating pieces 2 are retained in the circular grooves 11 of the upright support rod 1. The locating pieces 2 are embraced by the holding piece 3 such that the tenon 73 and the mortise 72 of the male piece 31 are engaged with the mortise 72 and the tenon 73 of the female piece 32, and the retaining bodies 71 of the male piece 31 and the female piece 32 form a retaining seat 8 for retaining the retaining piece 9 of the shelves 92. As shown in FIG. 4, the shelf 92 may be lifted so as to enable the male piece 31 and the female piece 32 to be opened up such that the tenons 73 and the mortises 72 of the male piece 31 and the female piece 32 are no longer engaged with each other, thereby enabling the locating piece 2 to be relocated on the upright support rod 1. As a result, the shelf 92 can be easily and selectively relocated at various levels of the upright support rod 1.

Figure 5:
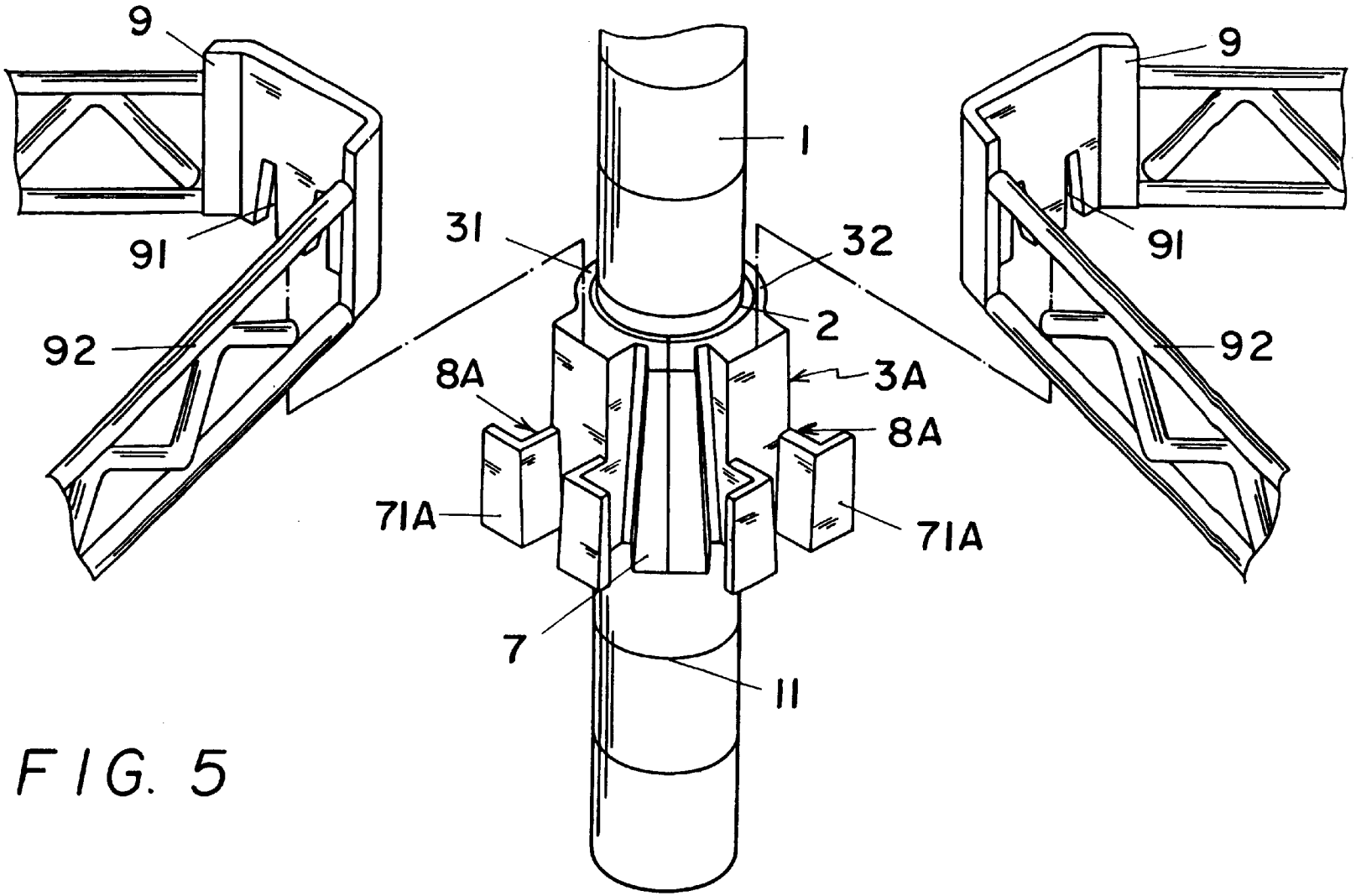
FIG. 5 shows a second embodiment of the present invention.
Figure 6:
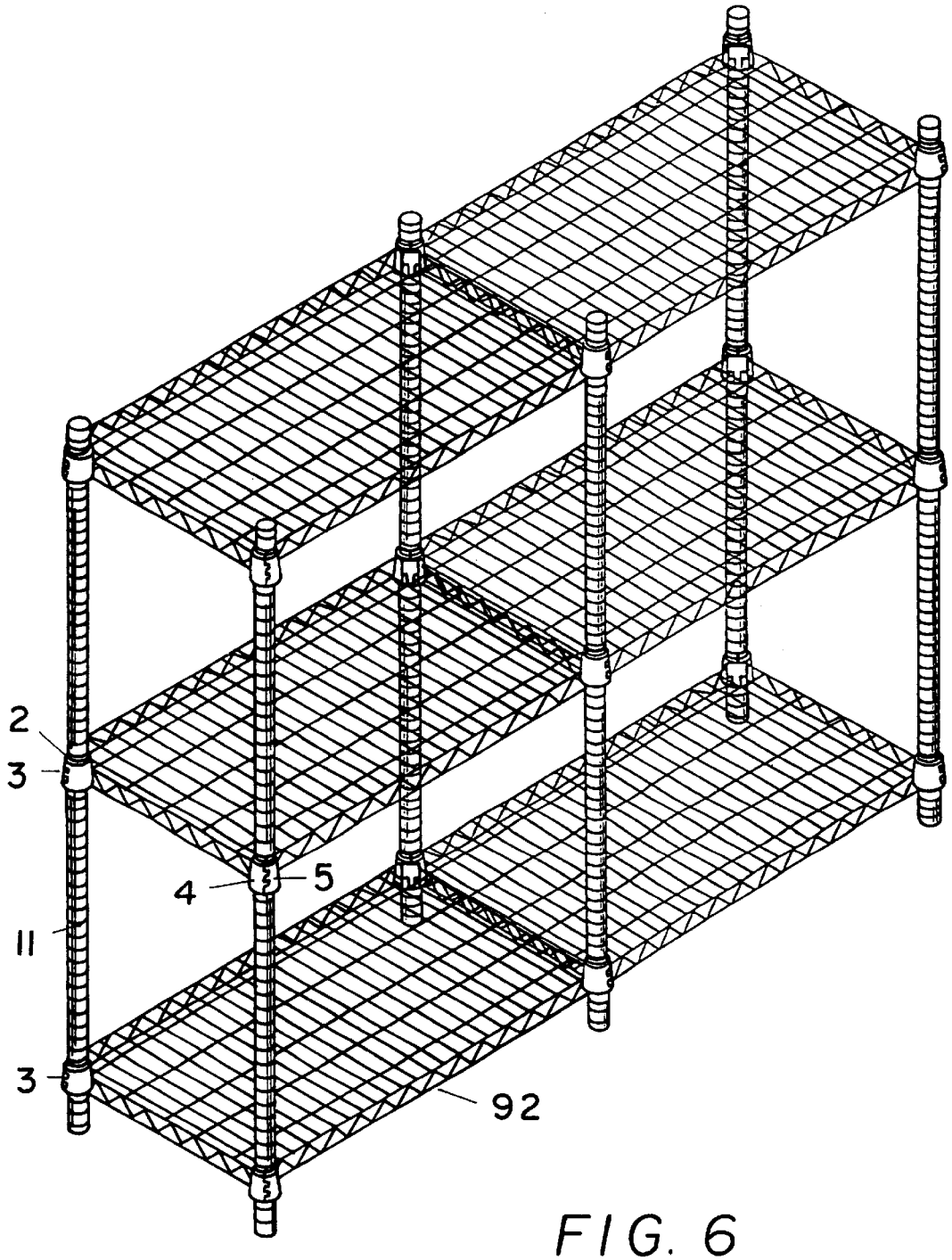
FIG. 6 shows the second embodiment with assembled shelves.
Figure 7:
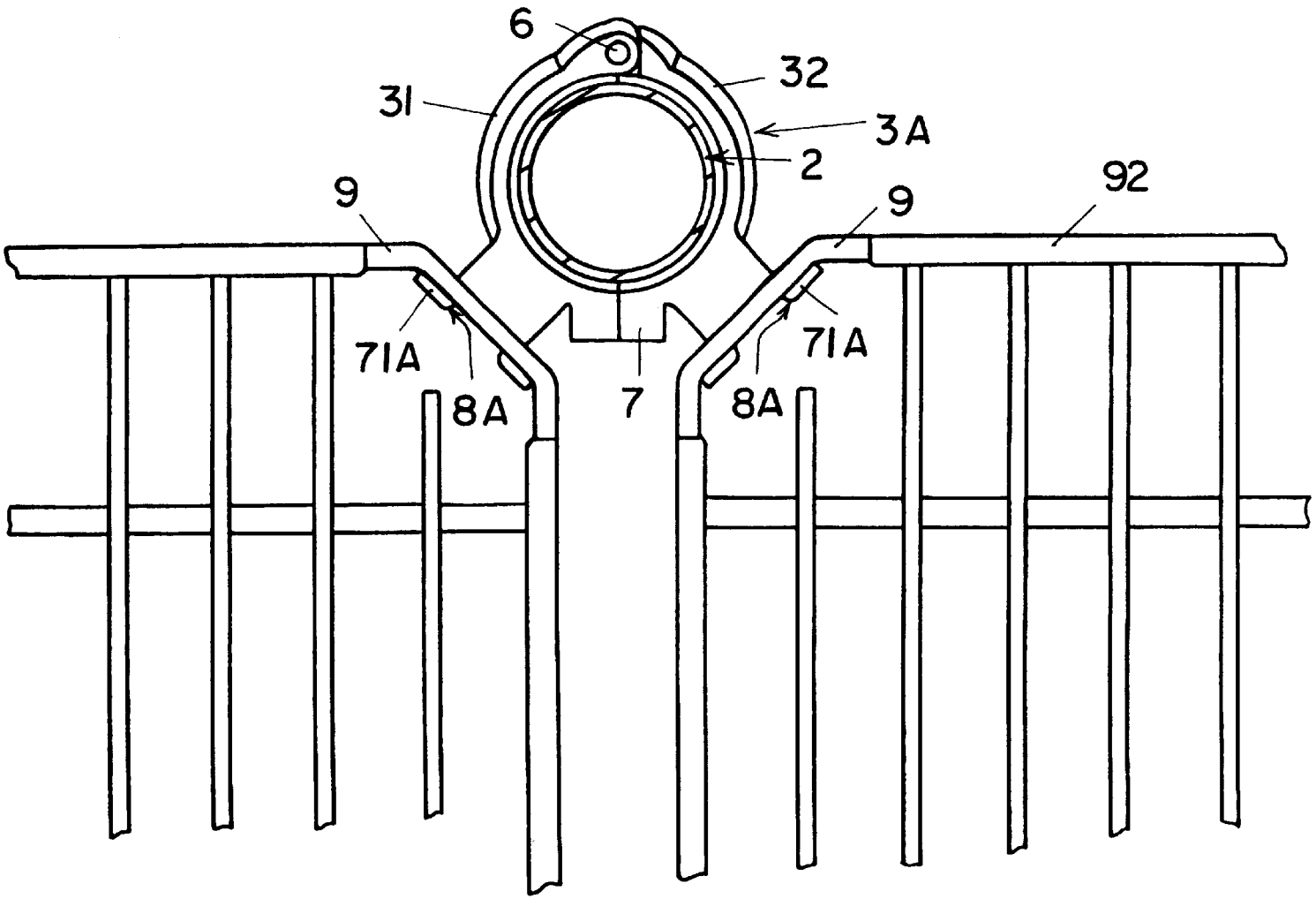
FIG. 7 shows a top view of the present invention.

As shown in another embodiment in FIG. 5, two retaining seats 8A of the holding pieces 3A are disposed on opposite sides of the protrusions 7 of the male piece 31 and the female piece 32 such that the two retaining seats 8A, along with their corresponding retaining bodies 71A, form therebetween an angle of 90 degrees, so as to facilitate the joining of a plurality of racks, as shown in FIG. 6. Such a modular rack can also be disassembled easily by following the steps which were described above in conjunction with FIG. 4. FIG. 7 shows a top view of the second embodiment depicted in FIG. 5 in an assembled condition.

What is claimed is:

1. A rack comprising a plurality of upright support rods, a plurality of rectangular shelves, a retaining piece at each corner of each shelf, a plurality of locating pieces engageable on said upright support rods, and a plurality of holding pieces, each holding piece engageable around a locating piece and including at least one retaining seat engageable by a retaining piece for supporting a corner of the shelf and securing the holding piece around the locating piece, wherein said holding pieces are each formed of a male piece and a female piece, said male piece being provided in a first side thereof with a first joint, and in a second side thereof with a first protrusion having a first retaining body, a first mortise, and a first tenon, said female piece being provided in a first side thereof with a second joint, and in a second side thereof with a second protrusion having a second retaining body, a second mortise, and a second tenon, said male piece and said female piece are engageable together such that said first joint and said second joint are secured together by a pin so that said first mortise is engaged with said second tenon, said first tenon is engaged with said second mortise, and said first retaining body and said second retaining body collectively form the at least one retaining seat engageable by the retaining piece.

2. The rack as defined in claim 1, wherein said holding piece includes two retaining seats forming an angle of 90 degrees therebetween for permitting the joining of a plurality of racks to form a modular rack.

* * * * *